US011283195B2

(12) United States Patent
Jang et al.

(10) Patent No.: US 11,283,195 B2
(45) Date of Patent: Mar. 22, 2022

(54) FAST ROLLOFF ANTENNA ARRAY FACE WITH HETEROGENEOUS ANTENNA ARRANGEMENT

(71) Applicant: JOHN MEZZALINGUA ASSOCIATES, LLC, Liverpool, NY (US)

(72) Inventors: Taehee Jang, Fayetteville, NY (US); Niranjan Sundararajan, Liverpool, NY (US); Jordan Ragos, Syracuse, NY (US)

(73) Assignee: JOHN MEZZALINGUA ASSOCIATES, LLC, Liverpool, NY (US)

( * ) Notice: Subject to any disclaimer, the term of this patent is extended or adjusted under 35 U.S.C. 154(b) by 0 days.

(21) Appl. No.: 16/962,892

(22) PCT Filed: Jan. 24, 2019

(86) PCT No.: PCT/US2019/014899

§ 371 (c)(1),
(2) Date: Jul. 17, 2020

(87) PCT Pub. No.: WO2019/147769

PCT Pub. Date: Aug. 1, 2019

(65) Prior Publication Data

US 2021/0050675 A1 Feb. 18, 2021

Related U.S. Application Data

(60) Provisional application No. 62/621,314, filed on Jan. 24, 2018.

(51) Int. Cl.

| | |
|---|---|
| ***H01Q 21/26*** | (2006.01) |
| ***H01Q 5/42*** | (2015.01) |
| ***H01Q 1/24*** | (2006.01) |

(52) U.S. Cl.
CPC ..... *H01Q 21/26* (2013.01); *H01Q 1/246* (2013.01); *H01Q 5/42* (2015.01)

(58) Field of Classification Search
CPC ..... H01Q 21/26; H01Q 5/42; H01Q 1/246
See application file for complete search history.

(56) References Cited

U.S. PATENT DOCUMENTS

| | | | | |
|---|---|---|---|---|
| 9,979,078 | B2 * | 5/2018 | Koskiniemi | H01Q 1/42 |
| 2007/0290938 | A1 * | 12/2007 | Loyet | H01Q 5/42 343/795 |

(Continued)

FOREIGN PATENT DOCUMENTS

| | | | |
|---|---|---|---|
| CN | 104600439 | A | 5/2015 |
| CN | 205231255 | U | 5/2016 |
| CN | 107611605 | A | 1/2018 |

OTHER PUBLICATIONS

International Search Report and Written Opinion dated Aug. 9, 2019, from International Application No. PCT/US2019/014899, 10 pages.

*Primary Examiner* — Lam T Mai
(74) *Attorney, Agent, or Firm* — Meunier Carlin & Curfman LLC

(57) ABSTRACT

A multiband antenna has a plurality of first, unit cells and second unit cells. Each first unit cell has two high band radiator clusters and two low band radiators disposed approximately in the center of each of the high band radiator clusters. Each second unit cell has two high band radiator clusters and one low band radiator that is disposed between the two high band radiator clusters. The first unit cell is designed for a superior low band gain pattern, and the second unit cell is designed for a superior high band gain pattern. By selectively arranging the first and second unit cells in a specific heterogeneous pattern, the characteristics of the two unit cells may advantageously and constructively (Continued)

combine to form a high performance antenna gain pattern that is consistent across the low band and high band.

19 Claims, 16 Drawing Sheets

(56) References Cited

U.S. PATENT DOCUMENTS

| | | | | |
|---|---|---|---|---|
| 2007/0297398 | A1* | 12/2007 | Loyet | H01Q 5/321 370/382 |
| 2010/0289717 | A1* | 11/2010 | Arslan | H01Q 3/30 343/876 |
| 2016/0172757 | A1 | 6/2016 | Gottl | |
| 2016/0254594 | A1 | 9/2016 | Jones et al. | |
| 2017/0018845 | A1* | 1/2017 | Lee | H01Q 1/521 |
| 2017/0062944 | A1* | 3/2017 | Zimmerman | H01Q 1/246 |
| 2017/0062952 | A1* | 3/2017 | Sundararajan | H01Q 1/523 |
| 2018/0034161 | A1* | 2/2018 | Le | H01Q 15/0013 |
| 2020/0079079 | A1* | 3/2020 | Adachi | B41J 2/04581 |
| 2020/0212537 | A1* | 7/2020 | Chuang | H01Q 9/0407 |
| 2020/0328533 | A1* | 10/2020 | Sundararajan | H01Q 21/062 |

* cited by examiner

FAST ROLLOFF ANTENNA ARRAY FACE WITH HETEROGENEOUS ANTENNA ARRANGEMENT

BACKGROUND OF THE INVENTION

Field of the Invention

The present invention relates to wireless communications, and more particularly, to multiband cellular antennas.

Related Art

There is a great demand for macro antennas that have a well-behaved fast-rolloff pattern in both the low band (LB) (e.g., 700 MHz-960 MHz) and the high band (HB)(e.g., 1.695 GHz-2.69 GHz). This is particularly true for antennas that are mounted on a tower such that each antenna has its own angular sector in the azimuth plane. In such a case, given the placement of the antennas, each will have a specific azimuth allocation, and if the antennas have a poorly behaved gain pattern in the azimuth plane (e.g., extensive sidelobes) then those antennas will cause interference with each other where their respective gain patterns overlap. Accordingly, a cluster of antennas with consistent and well behaved gain patterns in both the LB and the HB will minimize interference due to overlapping sidelobes.

Well behaved gain patterns are difficult to achieve for both the LB and the HB because the design of the array face for one of the bands will impact the performance of the other. For example, a given LB radiator design, and its arrangement relative to the positions of the HB radiators, may contaminate the performance of the HB array face, and vice versa. Inter-band effects may include co-polarization interference, cross-polarization interference, and shadowing. One way to reduce the interference between the LB and HB radiators is for the radiators to be integrated with cloaking elements. However, cloaking is not 100% effective in preventing cross coupling between the LB and HB. Further, cloaked radiator structures can be complex and expensive to manufacture. Accordingly, to reduce the manufacturing costs of an antenna, it may be desirable to minimize the use of cloaking in the design of the radiators.

Accordingly, what is needed is a macro antenna that is easy to manufacture and has consistent and well behaved performance in both the LB and HB such that interference between the LB and HB radiators is reduced, and both the LB and HB have well controlled fast rolloff gain patterns to minimize sidelobe interference with other nearby antennas.

SUMMARY OF THE INVENTION

Accordingly, the present invention is directed to an integrated filter radiator for multiband antenna that obviates one or more of the problems due to limitations and disadvantages of the related art.

An aspect of the present invention involves a multiband antenna that comprises a plurality of first unit cells, each first unit cell having two first high band radiator clusters disposed side by side along an azimuth axis, and two first low band radiators, each of the first low band radiators disposed substantially at a phase center of a corresponding first high band radiator cluster. The antenna further comprises a plurality of second unit cells, each second unit cell having two second high band radiator clusters disposed side by side along the azimuth axis, and a second low band radiator disposed between the two adjacent second high band radiator clusters, wherein the pluralities of first and second unit cells are arranged along an elevation axis.

In another aspect of the present invention, a multiband antenna comprises a plurality of first unit cells, each first unit cell having at least two first high band radiator clusters disposed side by side along an azimuth axis, and a first quantity of low band radiators disposed substantially at a phase center of a corresponding first high band radiator cluster, wherein the first unit cells are designed to have superior low band performance relative to high band performance. The antenna further comprises a plurality of second unit cells, each second unit cell having at least two second high band radiator clusters disposed side by side along the azimuth axis, and a second quantity of low band radiators, each of the second quantity of low band radiators disposed between two adjacent first high band radiator clusters, wherein the second unit cells are designed to have superior high band performance relative to low band performance, wherein the first quantity is not equal to the second quantity, and wherein the pluralities of first and second unit cells are interspersed and arranged heterogeneously along an elevation axis.

It is to be understood that both the foregoing general description and the following detailed description are exemplary and explanatory only, and are not restrictive of the invention as claimed

BRIEF DESCRIPTION OF THE DRAWINGS

The accompanying drawings, which are incorporated in and constitute a part of this specification, illustrate embodiment(s) of the integrated filter radiator for multiband antenna described herein, and together with the description, serve to explain the principles of the invention.

DESCRIPTION OF EXEMPLARY EMBODIMENTS

Figure 1:
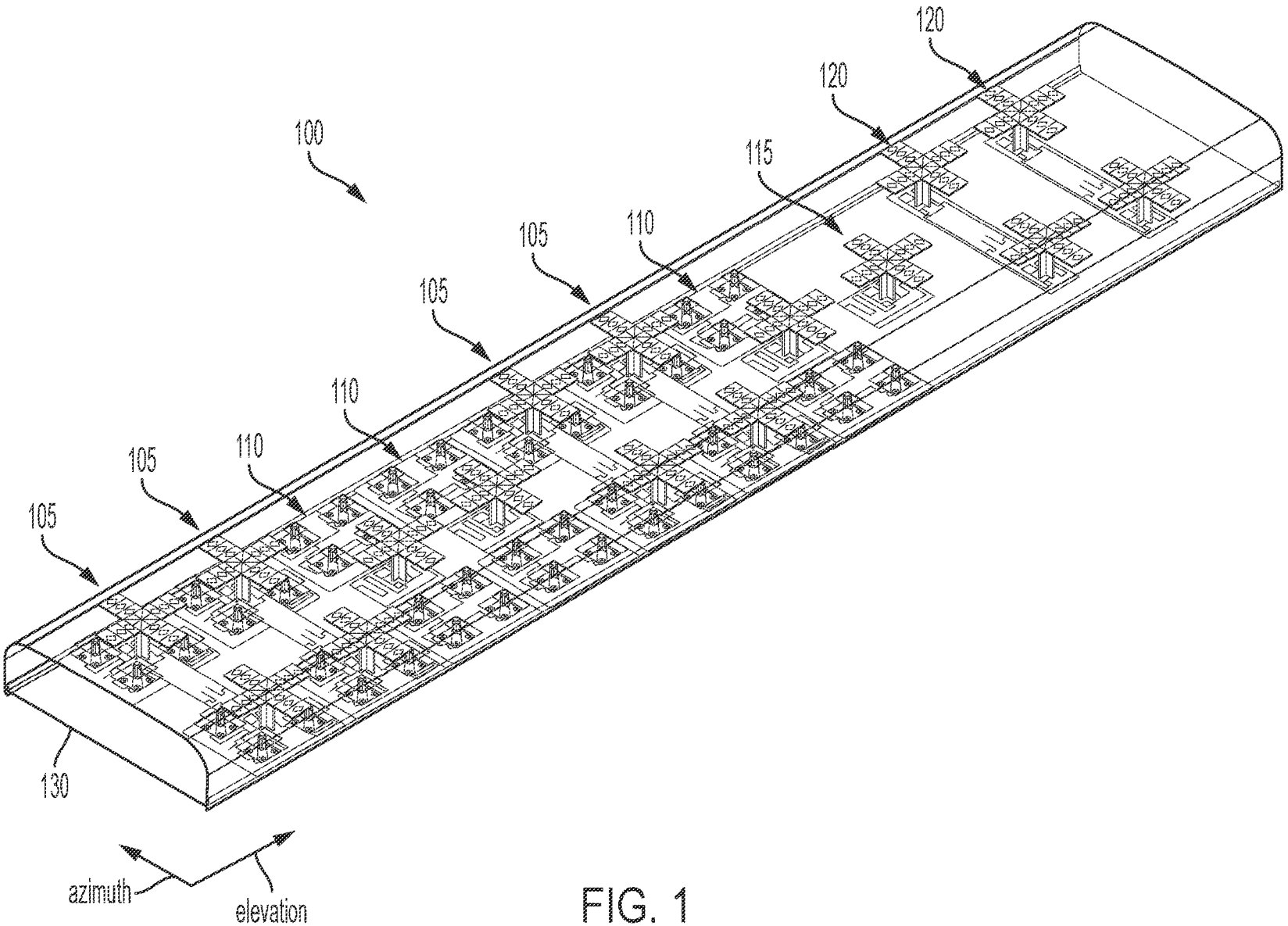
FIG. 1 illustrates an exemplary array face according to the disclosure.

Reference will now be made in detail to embodiments of the integrated filter radiator for multiband antenna with reference to the accompanying figures.

Disclosed is an antenna array face that has an arrangement of first unit cells and second unit cells. The first unit cell has an LB and HB radiator configuration that offers superior performance in the LB relative to the HB, and the second unit cell has an LB and HB radiator configuration that offers superior performance in the HB relative to the LB. The first and second unit cells can be arranged along the elevation axis (described later) so that the respective advantages and disadvantages balance, resulting in improved and more consistent performance in both the LB and HB.

The first unit cell has two clusters of four HB radiators and two LB radiators. The two LB radiators are located in or near the phase center of each of the HB radiator clusters. This unit cell offers superior LB performance due to the array factor achieved by the two LB radiators being spaced apart along an azimuth axis of the antenna (and the fact that two LB radiators are present), although it suffers from increased HB shadowing relative to the first unit cell.

The second unit cell has two clusters of four HB radiators (substantially similar to the first unit cell) and a single LB radiator that is located in the center between the two HB radiator clusters. This unit cell offers superior HB performance because the single LB radiator is located off center to the two HB clusters, minimizing HB shadowing from the LB radiator arms.

Further, having a first unit cell and a second unit cell disposed adjacent to each other offers an improved LB pattern whereby the combination of the two LB radiators spaced apart from the array center in the azimuth axis (first unit cell) and the single LB radiator located at the array center along the azimuth axis (second unit cell) offers an array face of three closely spaced LB radiators along the azimuth axis. This yields an improved LB gain pattern in the azimuth axis, better than having a homogenous arrangement of two first unit cells adjacent to each other (e.g., two adjacent first unit cells).

By arranging the first and second unit cells in a particular sequence, the gain patterns of the respective first and second unit cells constructively and destructively interfere with each other such that superior radiation performance can be achieved. This can be enhanced by adjusting the power ratios of each of the first and second unit cells as a function of distance from the center of the array face along the elevation axis.

Further, depending on the total length of the antenna along the elevation axis, a plurality of third and fourth unit cells may be employed, whereby the third and fourth unit cells have only LB radiators. The third unit cell may be similar to the second unit cell but without the HB radiators, and the fourth unit cell may be like the first unit cell but without the HB radiators. One may append an arrangement of first and second unit cells with a sequence of third and fourth unit cells to improve the LB performance further, thereby better more closely matching the performance in the LB with that of the HB.

FIG. 1 illustrates an exemplary array face 100 according to the disclosure. Shown is a coordinate frame having two axes, an elevation axis and an azimuth axis. The elevation axis may coincide with a vertical axis of an antenna that is mounted on a tower. The placement of radiators along the elevation axis enables control of the shape of the antenna gain pattern. Further, differentially phasing the signals to these radiators along the elevation axis enables tilting of the gain pattern along the elevation axis. The azimuth axis may coincide with a horizontal direction that is parallel to the surface of array face 100 of an antenna that is mounted on a tower, and perpendicular to the elevation axis. By spacing radiators next to each other along the azimuth axis, it is possible to control the shape of the antenna gain pattern along the azimuth direction. The distance between radiators, or the total distance between end radiators along the azimuth axis, is referred to as an array factor. By arranging the unit cells in a specific sequence along the elevation axis, and differentially powering the unit cells as a function of distance from the center of the array face, an improved LB and HB gain pattern may be achieved in the azimuth direction. This is described later in more detail.

Exemplary array face 100 has a plurality of first unit cells 105 and second unit cells 110, arranged in a sequence along the elevation axis. Exemplary array face 100 may also have a plurality of third unit cells 115 and fourth unit cell 120. As described above, the third unit cell 115 may be substantially similar to the second unit cell 110 but without the HB radiators, and the fourth unit cell 120 may be substantially similar to the first unit cell 105 but also without the HB radiators.

The additional sequence of third and fourth unit cells 115 and 120 improves the LB gain pattern along both the elevation axis and azimuth axis substantially free of interference from the HB radiators.

As illustrated, all of the unit cells 105/110/115/120 are disposed on a reflector plate 130, which may be formed of a single conductive plate, or multiple coupled conductive plates, that may be integrated into the structure of antenna array face 100.

Figure 2:
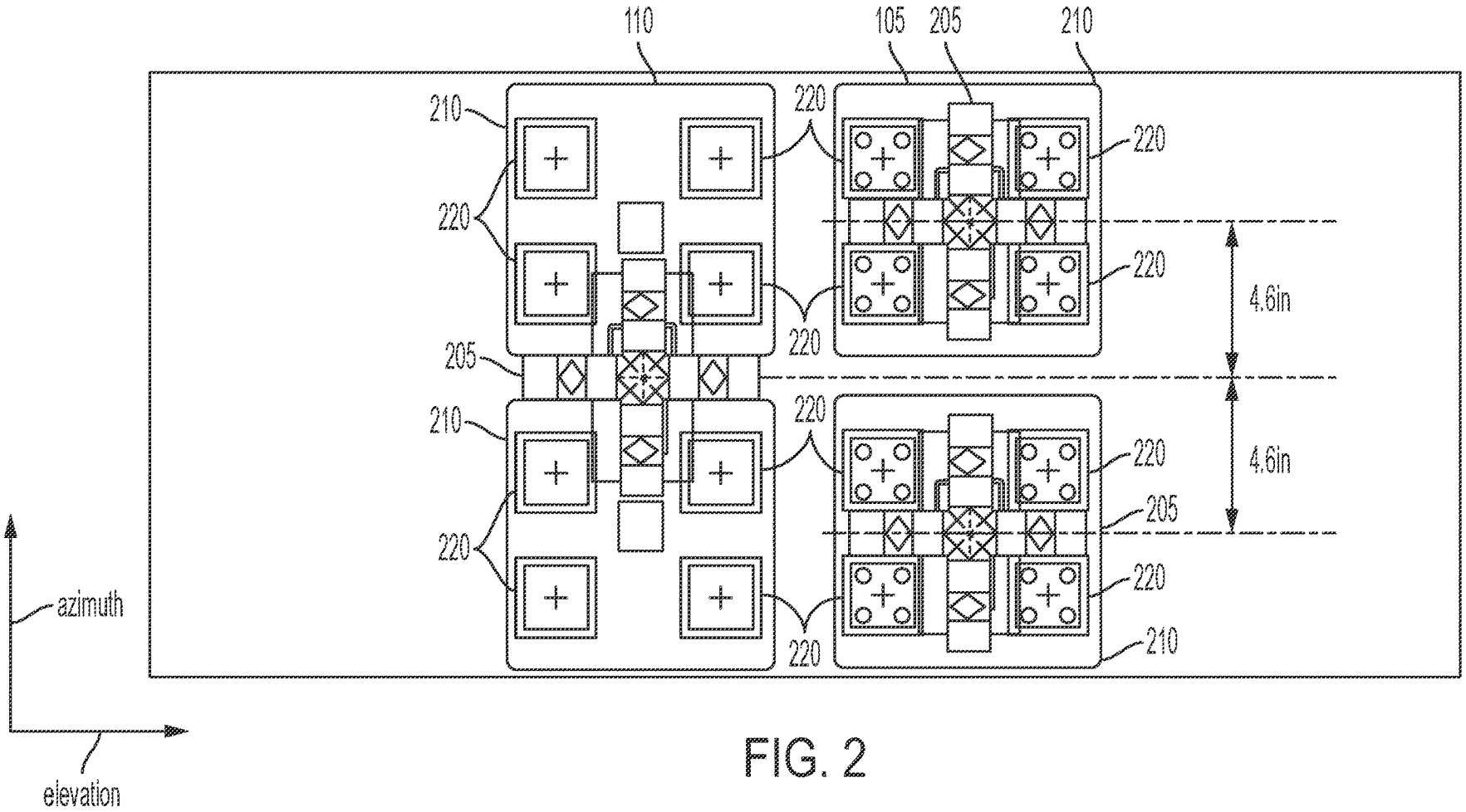
FIG. 2 illustrates a first pair of first and second unit cells according to the disclosure.

FIG. 2 illustrates a first pair of first and second unit cells according to the disclosure, including exemplary first unit cell 105 and exemplary second unit cell 110. First unit cell 105 includes two HB radiator clusters 210, each with four HB radiators 220, and two LB radiators 205, each located at the phase center of each of the HB radiator clusters 210. Second unit cell 110 has a substantially similar pair of HB radiator clusters 210, each with four HB radiators 220, and a single LB radiator 205 located between the two HB radiator clusters 210. As illustrated, the spacing between the LB radiators 205 may be 9.2 inches in the azimuth direction and 9.6 inches in the elevation direction; and spacing between the HB radiators 220 may be 3.68 inches in the azimuth direction and 4.8 inches in the elevation direction.

Each LB radiator 205 may be implemented as a dipole, and each HB radiator 220 may be implemented as a patch antenna element. It will be understood that variations are possible and within the scope of the disclosure.

Figure 3:
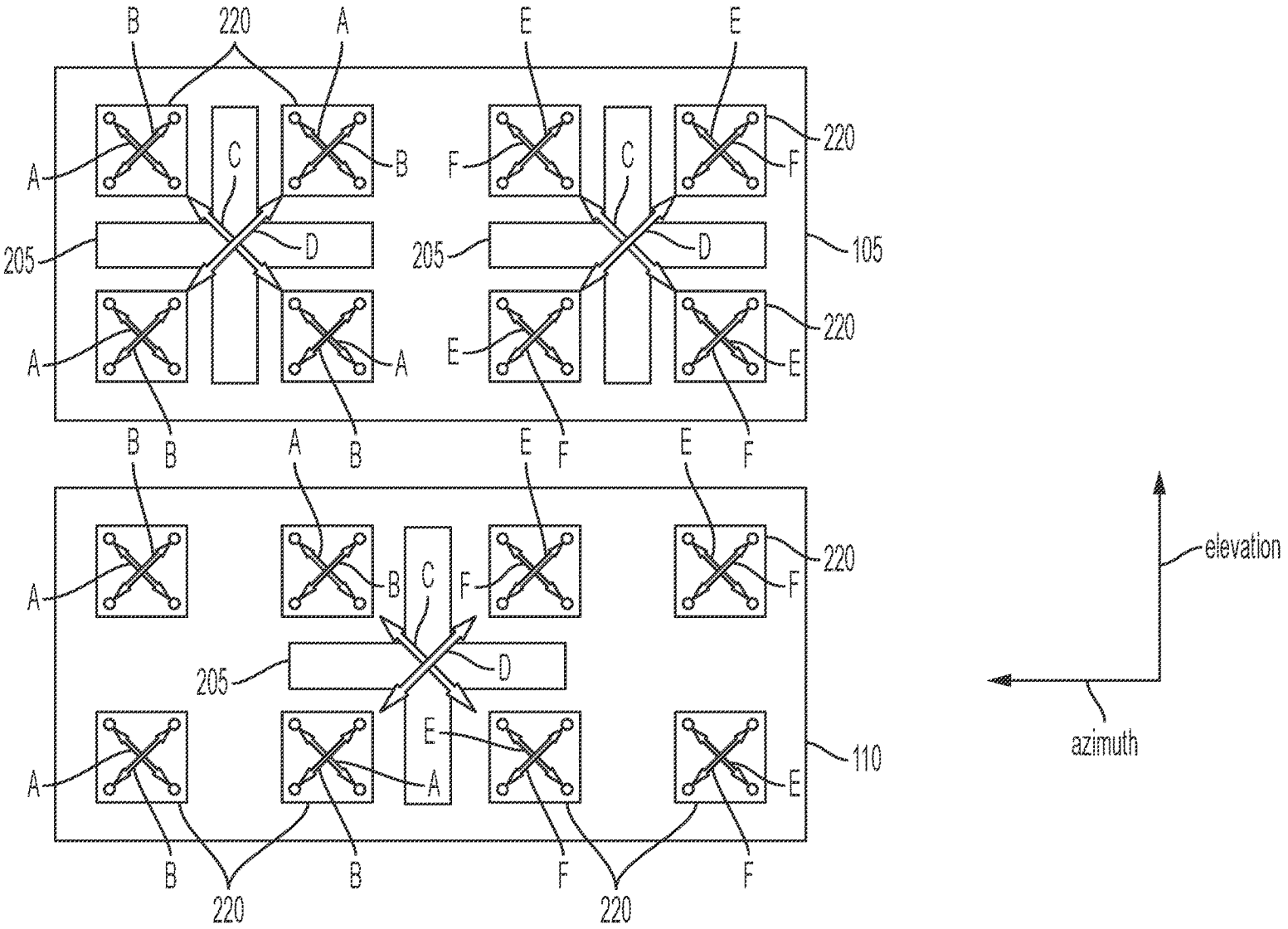
FIG. 3 illustrates the first pair of first and second unit cells in further detail.

FIG. 3 illustrates the first pair of first and second unit cells in further detail. Shown are exemplary first unit cell 105 and exemplary second unit cell 110, each including their respective clusters of HB radiators 220 and LB radiator(s) 205. Please note that the arrangement of first and second unit cells illustrated in FIG. 3 is rotated 90 degrees relative to the illustration of FIG. 2, which is clarified by the orientation of the azimuth and elevation axes in the figures. Also illustrated in FIG. 3 is a set of crossed arrows over each radiator 220 and 205. These refer to the polarization orientation of each RF signal radiated by the respective radiator 220/205.

Figure 4:
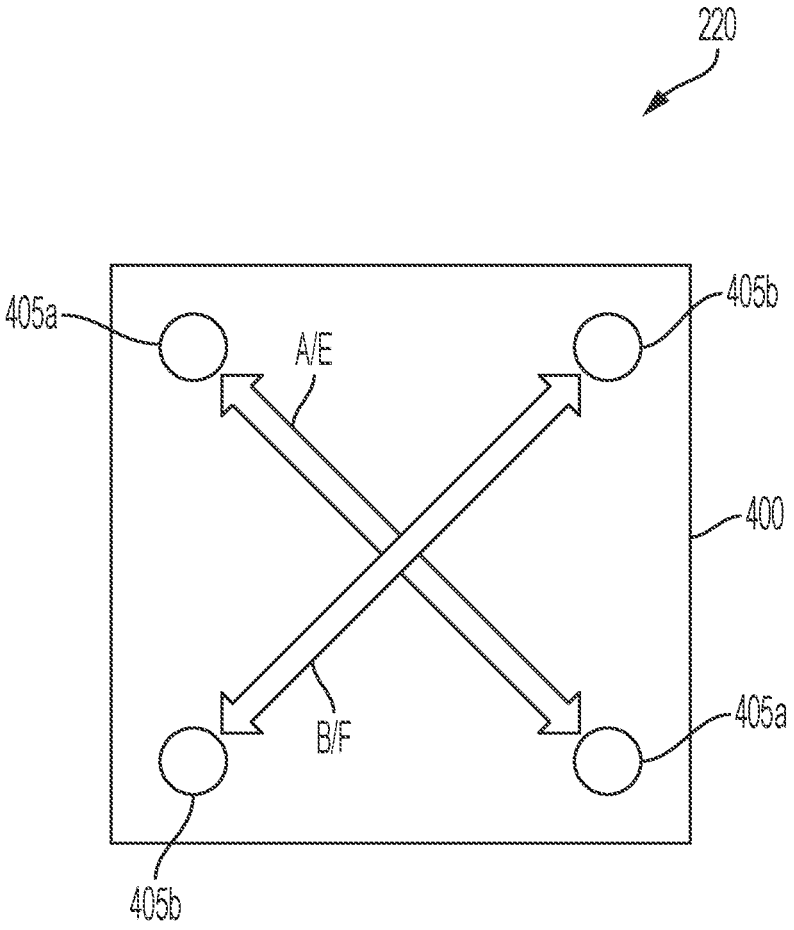
FIG. 4 illustrates an exemplary HB radiator as may be used in the disclosed array face.

Each illustrated HB radiator 220 may be implemented as a Probe-Fed Patch, which is illustrated in FIG. 4. The Probe-Fed Patch implementation includes a metal plate 400, two first RF signal differential signal contact points 405*a*, and two second RF signal differential signal contact points 405*b*. In operation, a first RF signal applied to the first RF signal differential signal contact points 405*a* imparts a current in metal plate 400, resulting in a radiated RF signal at a first polarization orientation. Similarly, a second RF signal applied to the second RF signal differential signal contact points 405*b* imparts a current in metal plate 400, resulting in a radiated RF signal at a second polarization orientation. Not shown in FIG. 4 is an optional triple-stack patch, which serves as a passive radiator that improves the bandwidth of HB radiator 220.

Returning to FIG. 3, the "left" side HB radiator clusters 210 of four HB radiators 220 within both first unit cell 105 and second unit cell 110 may operate as described with respect to FIG. 4 for two RF signals, "A" and "B", each with a polarization orientation (+/−45 degrees) orthogonal to the other. The "right" side HB radiator clusters 210 of four HB radiators 220 within both first unit cell 105 and second unit cell 110 may operate similarly, but with two different RF signals, "E" and "F", each also with a polarization orientation (+/−45 degrees) orthogonal to the other. In doing so, antenna array face 100 may operate with four HB RF ports in two pairs, each pair corresponding to a column of two adjacent HB radiators 220 oriented in the azimuth direction, providing an array factor that provides for beamwidth control along the azimuth axis, and for beamwidth and pitch control along the elevation axis. Beam pitch (or tilt) control may be implemented via phase shifters (not shown) that provide differential phasing to the HB radiator clusters 210 for a given signal pair (A/B, or E/F) along the elevation axis.

LB radiators 205 radiate two RF signals, each orthogonal to the other in a +/−45 degree configuration, designated as "C" and "D" in FIG. 3. In this case, each LB radiator 205 has a mechanism that rotates the polarization states by 45 degrees relative to the orientation of the vertical/horizontal LB radiator arms. There are several ways of accomplishing this, one of which is to employ a special purpose feed network that feeds, for each RF signal, 0 degree and 180 degree phase shifted signals to the vertical and horizontal radiator arms such that the additive signals combine to reconstruct each RF signal in both the vertical and horizontal radiator arms with relative phases so that the polarization vector for each RF signal is rotated 45 degrees.

Figure 5A:
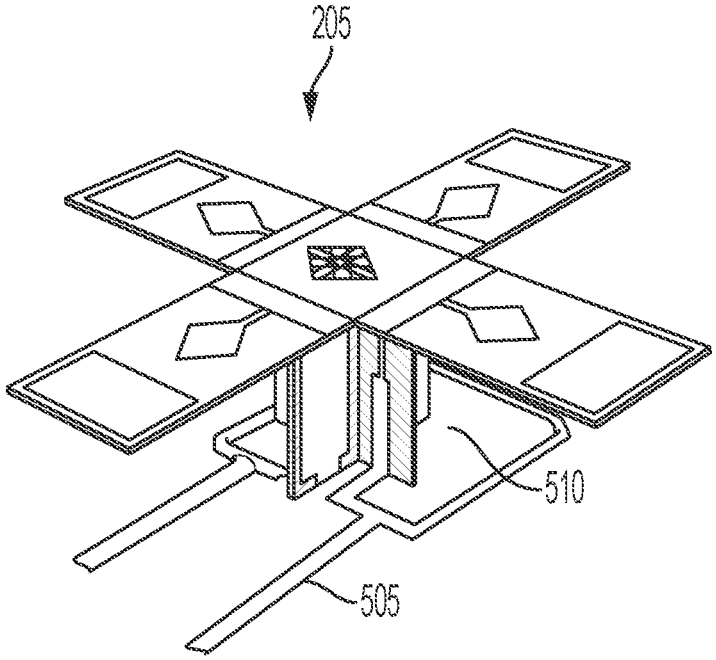
FIG. 5*a* illustrates an exemplary LB radiator as may be used in the disclosed array face.
Figure 5B:
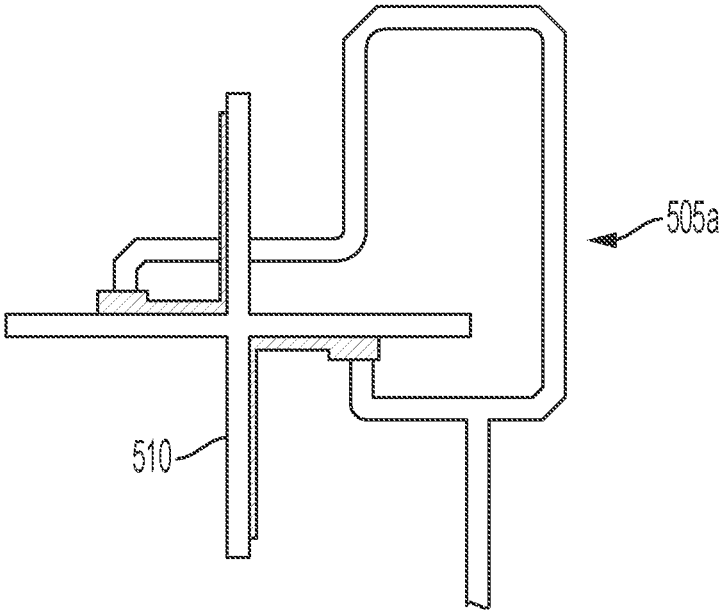
FIG. 5*b* illustrates a first portion of an exemplary LB radiator feed network as may be used in the disclosed array face.
Figure 5C:
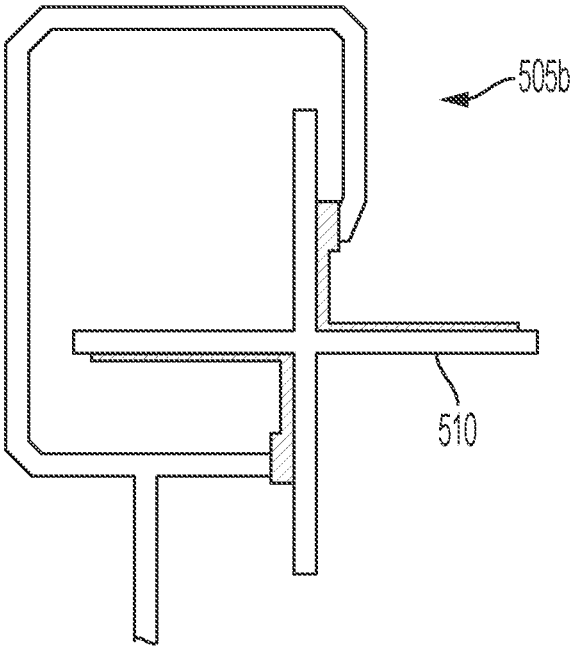
FIG. 5*c* illustrates a second portion of an exemplary LB radiator feed network as may be used in the disclosed array face.

FIG. 5*a* illustrates an exemplary LB radiator that employs a feed network 505 that imparts a 45 degree rotation in polarization output. FIG. 5*b* illustrates a "top down" view of the feed network 505*a* for one of the RF signals and how it connects to the balun stem 510 of the LB radiator 205; and FIG. 5*c* illustrates a "top down" view of the counterpart feed network 505*b* and how it connects to balun stem 510 for the other of the two RF signals. For a further description of this LB radiator and feed network, refer to co-owned U.S. patent applications 62/567,809 and 62/587,926, both titled "Integrated Filer Radiator for a Multiband Antenna", both of which are incorporated by reference as if fully disclosed herein. Alternatively, other approaches may be taken to impart a 45 degree rotation on the LB polarization state—such as use of hybrid couplers—to impart the necessary phase shifts.

Accordingly, an antenna that has a combination of first and second unit cells as disclosed in FIG. 3 would be a 6-port antenna: 4 HB RF ports (one for each of signals A, B, E, F) and 2 LB ports (one for each of signals C, D). It will be understood that variations to this configuration are possible and within the scope of the disclosure.

Figure 6:
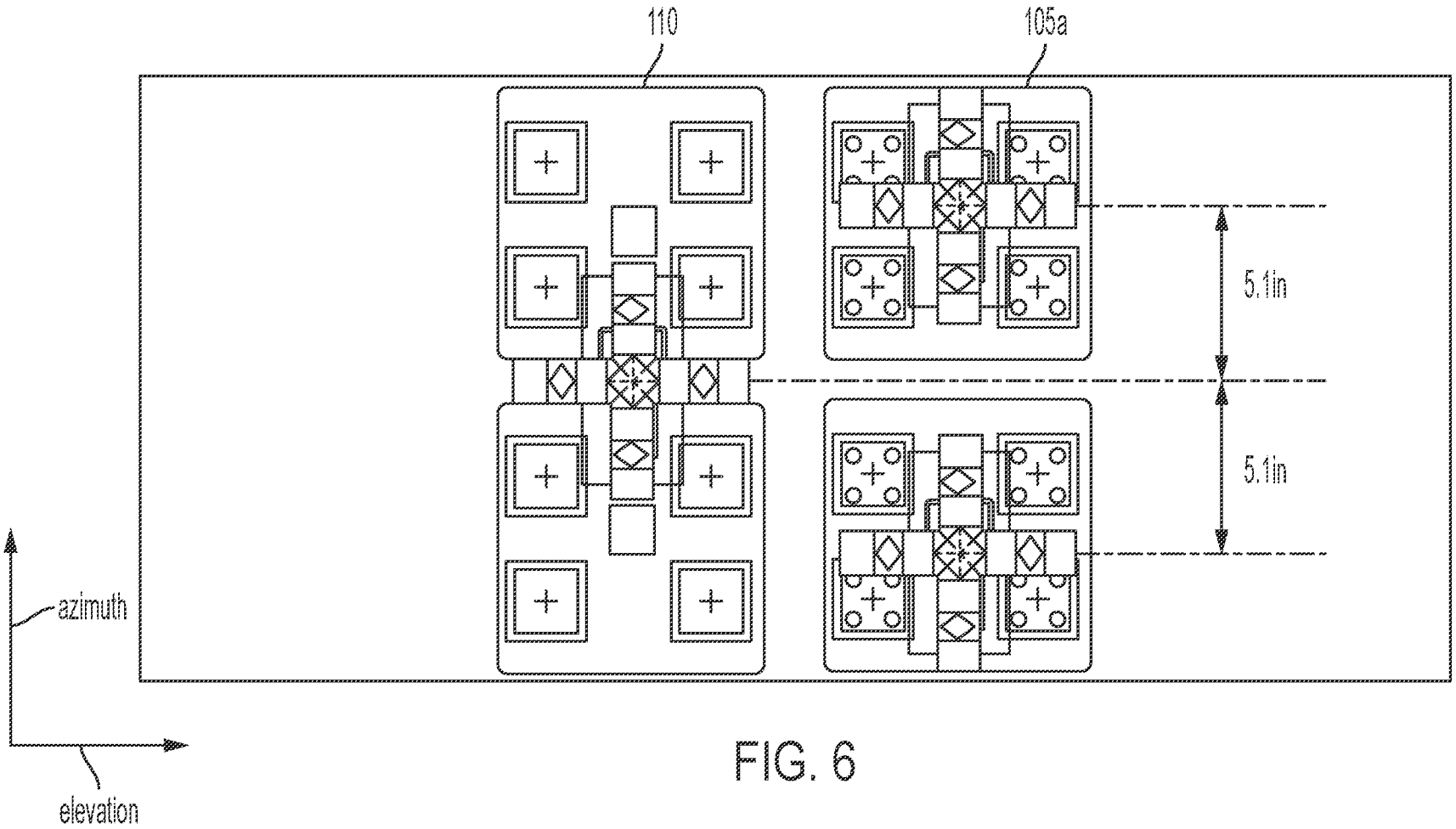
FIG. 6 illustrates a second pair of first and second unit cells according to the disclosure.

FIG. 6 illustrates a second pair of first and second unit cells according to the disclosure. For the second pair, the HB radiator configuration is substantially similar to the first pair illustrated in FIG. 2. The key difference here is that, in the first unit cell 105*a*, the position of LB radiators 205 are translated such that they are offset relative to the phase center of their respective HB radiator clusters 210. Accordingly, the spacing of the HB radiators 220 along the azimuth and elevation axis is the same as for FIG. 2. The spacing of the LB radiators 205, however are spaced apart by 10.2 inches in the azimuth direction, increasing the array factor relative to the embodiment illustrated in FIG. 2.

Figure 7:
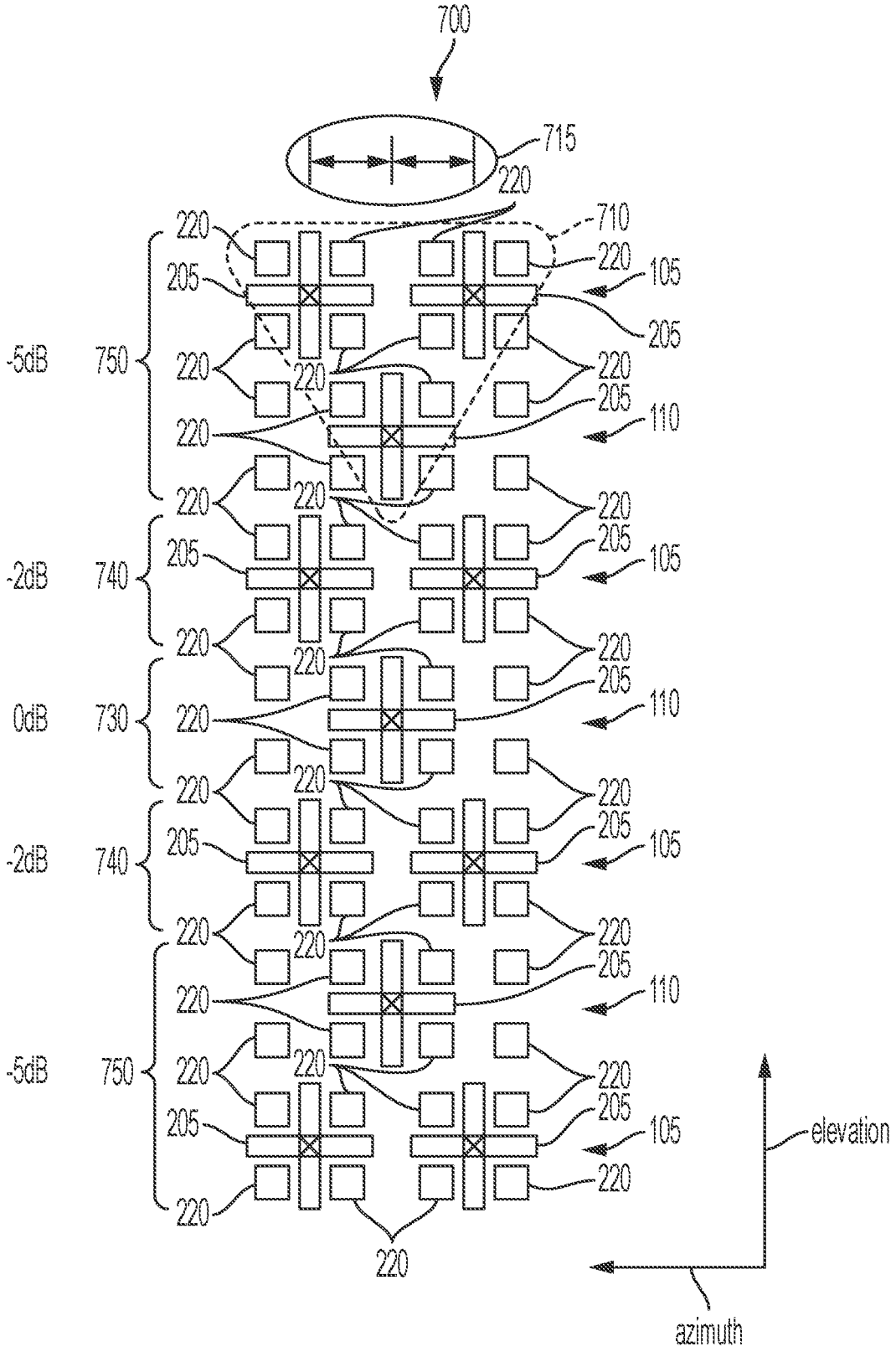
FIG. 7 illustrates an exemplary 40 degree azimuth, 6 foot macro antenna array face unit cell configuration according to the disclosure.

FIG. 7 illustrates an exemplary array face 700, which may be implemented in a 40 degree azimuth, 6 foot cellular macro antenna. Array face 700 has a plurality of first unit cells 105 and second unit cells 110 arranged in an alternating pattern. Array face 700 also has a power distribution configuration with the following: a maximum power (0 dB) zone 730 (also referred to as a zero attenuation power zone) that includes the second unit cell 110 at the center of the array face 700 along the elevation axis, which is provided full RF power; two first attenuation power zones 740 adjacent to the zero attenuation power zone 730 on either of its sides, each first attenuation power zone 740 having a first unit cell 105, wherein the two first attenuation power zones have a power attenuation of −2 dB; and two second attenuation power zones 750, each disposed adjacent to and at an end of array face 700 and having a second unit cell 110 and a first unit cell 105 along the elevation axis, wherein each second attenuation power zone 750 has a power attenuation of −5 dB. Implementing a power distribution along the elevation axis improves the gain pattern both in the elevation and azimuth axis, by selectively adjusting each unit cell's power contribution, via constructive and destructive interference, to the overall gain pattern of the array face 700. The use of power zones is particularly useful in antennas that use phase shifters for differentially phasing the RF signals to regions 740 and 750 (relative to region 730) for tilting the gain pattern of array face 700 along the elevation axis.

As mentioned earlier, having first and second unit cells 105/110 adjacent to each other along the elevation axis improves the array factor in the LB. This is illustrated in FIG. 7, which has three LB clusters 710, one of which is highlighted in the figure. LB cluster 710 includes a first unit cell 105 and a second unit cell 110 disposed adjacent to each other. First unit cell 105 has two LB radiators 205 spaced apart along the azimuth axis. This spacing provides for an array factor, whereby the gain patterns of the two LB radiators 205 in the first unit cell 105 interfere with each other to tighten the combined gain pattern, constricting the angular extent of the gain pattern along the azimuth. However, the gain pattern resulting from the array factor of the first unit cell 105 may be inadequate in terms of sidelobes and angular extent in the azimuth axis. However, the second unit cell 110 within LB cluster 710, with its single LB radiator 205 that is disposed in the array center along the azimuth axis, improves the LB gain pattern by having the resulting three LB radiators 205 contribute to a single array factor. Diagram 715 illustrates the azimuth-axis locations of the three LB radiators 205 within LB cluster 710. Although the center LB radiator 205 (in the second unit cell 110) is spaced apart from the other two "outer" LB radiators 205 (in the first unit cell 105) along the elevation axis, its gain pattern combines with the gain patterns of the other two LB radiators 205 to form a much improved LB gain pattern in the azimuth direction. Repeating this pattern (of LB cluster 710) along the elevation axis in array face 700 greatly improves the LB gain performance of the 6 foot macro antenna.

Array face 700 also improves HB performance by having a second unit cell 110 located in maximum power zone 730. As described earlier, second unit cell 110 has two separate HB radiator clusters 210, each with four radiators per RF signal, and a single LB radiator 205 that is located between the two radiator clusters 210 and thus minimizes shadowing of the LB radiator 205 on the HB radiator clusters 210. This enhanced efficiency in the HB is improved by having the second unit cell 110 located in maximum power region 730. Further, array face 700 has two additional second unit cells 110 located in second attenuation power zone 750 toward each end of array face 700 along the elevation axis. These three second unit cells 110 drive the HB performance of array face 700, along with contributions from the HB radiators 220 in first unit cells 105, combine their individual gain patterns to form a collective HB antenna gain pattern that has strong fast rolloff characteristics and minimal sidelobes.

Figure 8:
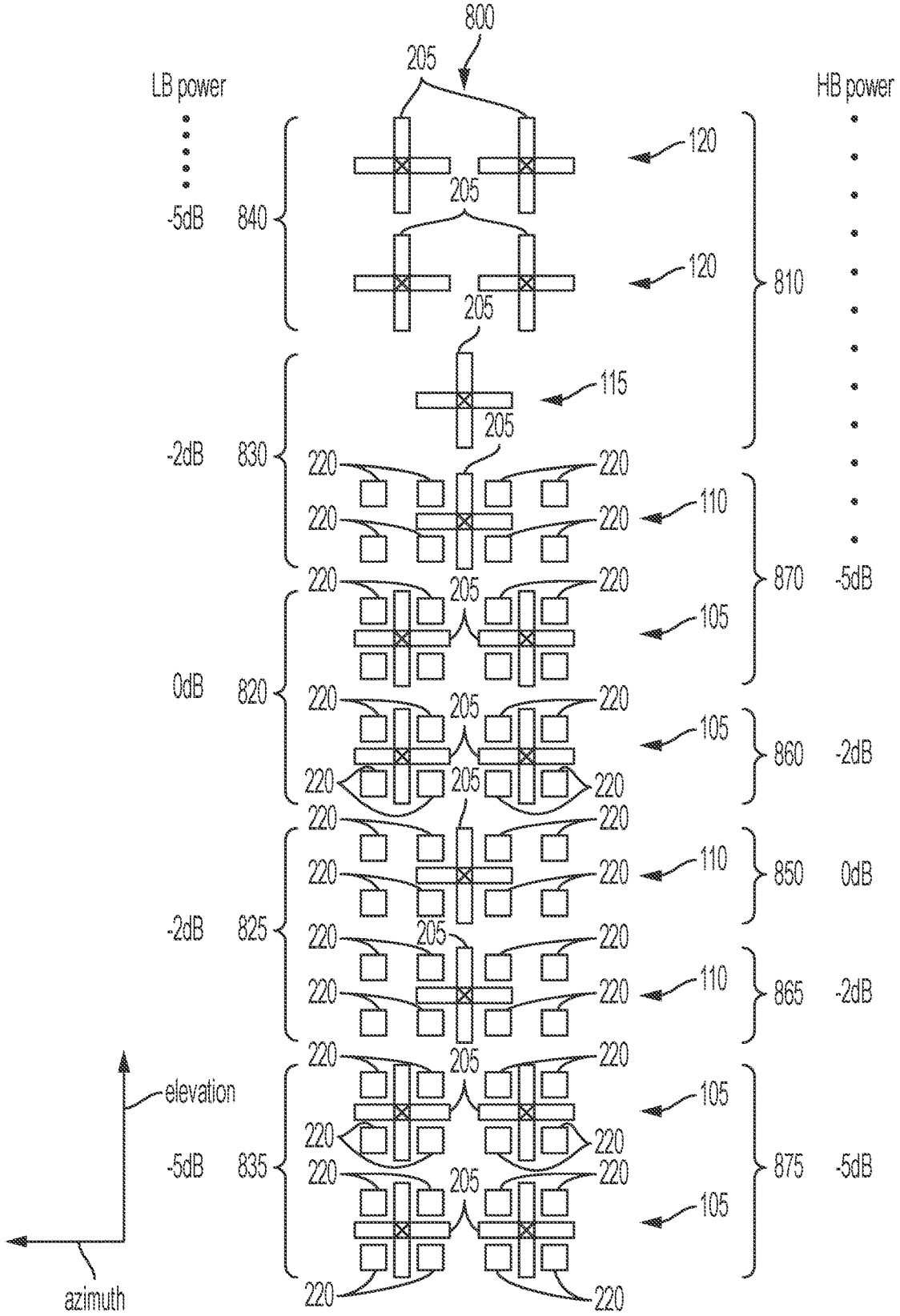
FIG. 8 illustrates an exemplary 40 degree azimuth, 8 foot macro antenna array face unit cell configuration according to the disclosure.

FIG. 8 illustrates an exemplary array face 800 that may be implemented in a 40 degree azimuth, 8 foot cellular macro antenna. Array face 800 may be the same as exemplary array face 100 as described above. Array face 800 may have first and second unit cells 105/110 as does array face 700, with the addition of LB-only region 810 having third and fourth unit cells 115/120, effectively creating two array faces: one for HB and one for LB. The presence of the two additional fourth unit cells 120, with their combined four LB clusters helps provide for a strong gain LB gain pattern.

Array face 800 may have two separate power distributions, one for the LB and one for the HB, that help take best advantage of the arrangement of unit cells 105/110/115/120.

For LB performance, array face 800 has a power distribution that divides it into a plurality of power zones: a maximum power (0 dB) zone 820 that includes two first unit cells 105; two −2 dB power zones 825 and 830; and two −5 dB power zones 835 and 840. As illustrated, the two −2 dB power zones 825/830 are disposed adjacent to maximum power zone 820, and the two −5 dB power zones 835/840 are disposed at the ends of array face 800 along the elevation axis. The −2 dB power zone 825 corresponds to two second unit cells 110, and the other −2 dB power zone 830 has one second unit cell 110 and a third unit cell 115. The −5 dB power zone 835 has two first unit cells 105, and the other −5 dB power zone 840 has two fourth unit cells 120. Extending the length of array face with the addition of LB-only region 810 improves the throughput of the LB portion of array face 800 as well as improves the quality of the LB gain pattern.

For HB performance, Array face 800 has a power distribution that divides it into a plurality of power regions: a maximum power (0 dB) zone 850 that is placed in the center of HB array antenna along the elevation axis and has a second unit cell 110; two −2 dB power zones 860 and 865; and two −5 dB power zones 870 and 875. As illustrated, the two −2 dB power zones 860/865 are disposed adjacent to maximum power region 850, and the two −5 dB power zones 870/875 are disposed at the ends of array face 800 along the elevation axis. The −2 dB power zone 860 has one first unit cell 110, and the other −2 dB power zone 865 has one second unit cell 105. The −5 dB power zone 870 has one first unit cell 105 and one second unit cell 110, and the other −5 dB power zone 875 has two first unit cells 105.

By providing a balanced combination of first and second unit cells 105/110—as well as a combination of additional unit cells 115/120—a balance of improved individual LB and HB performance and consistent performance quality between the LB and HB may be achieved. For example, for array face 800, more LB radiators 205 (due to more first and fourth unit cells 105/120) are disposed at the ends of the array face in the elevation direction, providing more LB power output and a better LB array factor for the antenna, whereby more unshadowed HB radiators 220 are located toward the center of array face 800 (due to more second and third unit cells 110/115), enabling greater HB power output. Further, the LB radiators 205 in LB-only region 810 are substantially free from any interference from HB radiators 220.

For both array faces 700 and 800, there is a central region of each array face in which unshadowed HB radiators 220 predominate, and there are outer regions of each array face in which LB radiators 205 predominate.

Figure 9:
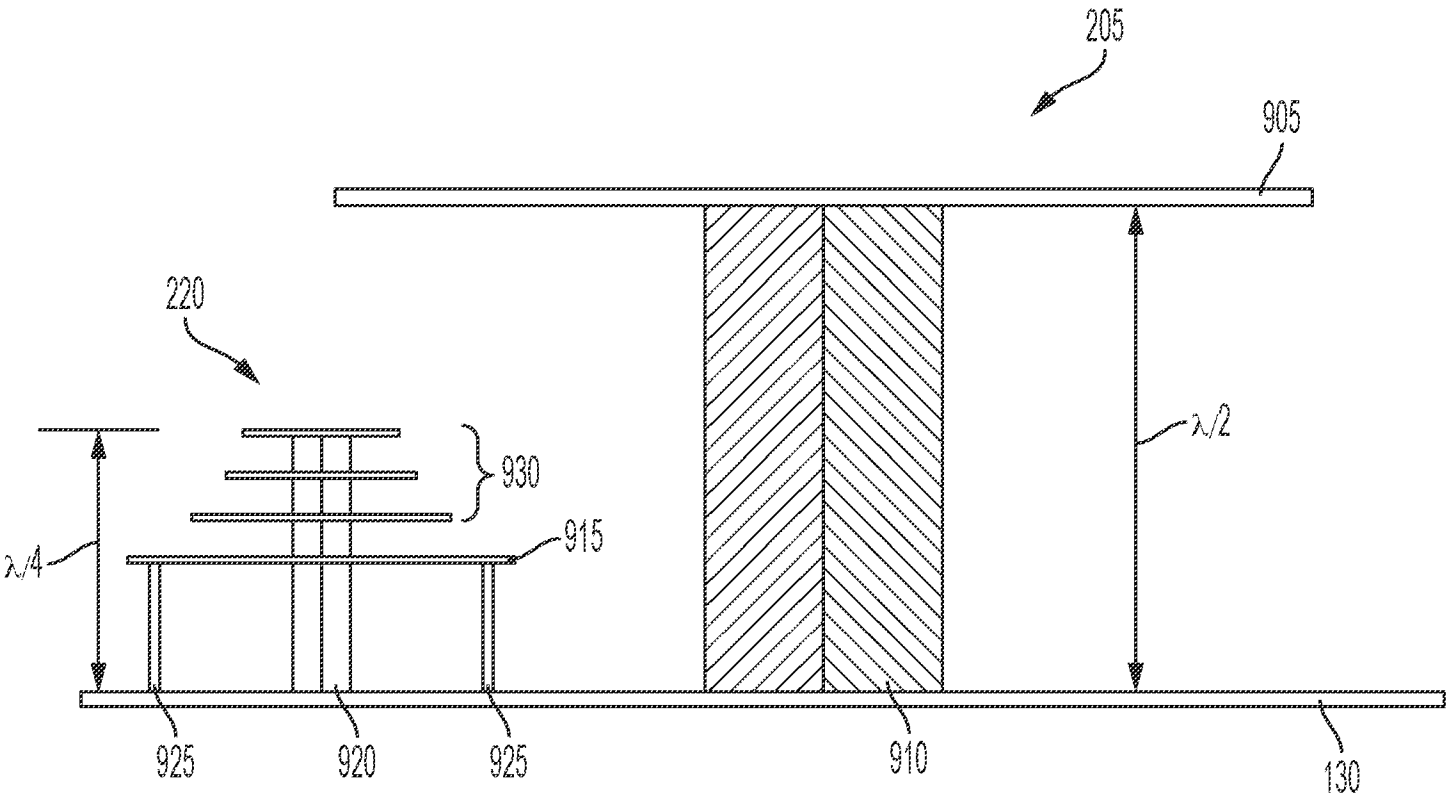
FIG. 9 is a side view of one of the unit cells, illustrating the relative heights of the LB and HB radiators.

FIG. 9 is a side view of either of the first or second unit cells, illustrating the heights of the radiator radiating elements. Shown are reflector plate 130; LB radiator 205, with LB radiator element 905 and balun stem 910; and HB radiator 220, with HB radiator feeding element 915, support pedestal 920, contact pins 925, and a triple stack patch passive radiator 930. As illustrated, LB radiator dipole element 905 may be disposed over reflector plate 130 at a height of approximately one half the wavelength corresponding to the LB center frequency ($\lambda/2$). Further, the HB feeding element 915 for probe-fed patch antenna and the triple stack patch passive radiator 930 (collectively HB radiator 220) may be mounted above the reflector plate 130 such that the top radiator plate of the triple stack patch passive radiator 930 is disposed at a height of approximately one quarter the wavelength corresponding to the LB center frequency ($\lambda/4$). In an exemplary embodiment, $\lambda/2$ may equal 3.2 inches. It will be understood that variations to this arrangement are possible and within the scope of the disclosure. For example, the HB radiator 220 may be of a different configuration (e.g., with a balun stem and without the passive radiator patch stack), in which case the height of the HB radiator would be at a height of approximately $\lambda/4$. The ratio of the heights of the HB vs. the LB is what makes for improved performance for both the HB and LB for array face 100. Generally, lowering the height of the LB radiator radiator 905 reduces the bandwidth, and increasing its height increases interference with the HB radiators 220.

Figure 10A:
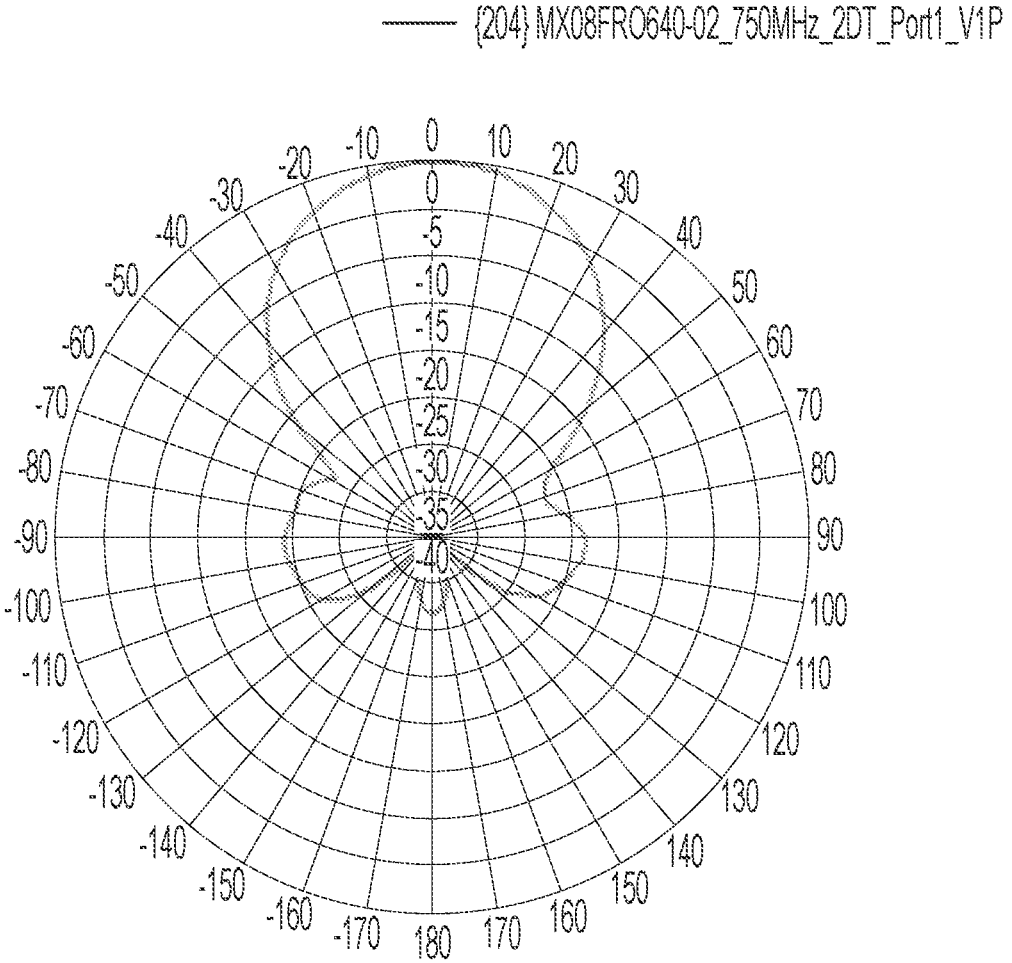
FIGS. 10*a* and 10*b* illustrate azimuthal gain patterns for two different LB frequencies for an exemplary 6 foot antenna according to the disclosure.
Figure 10B:
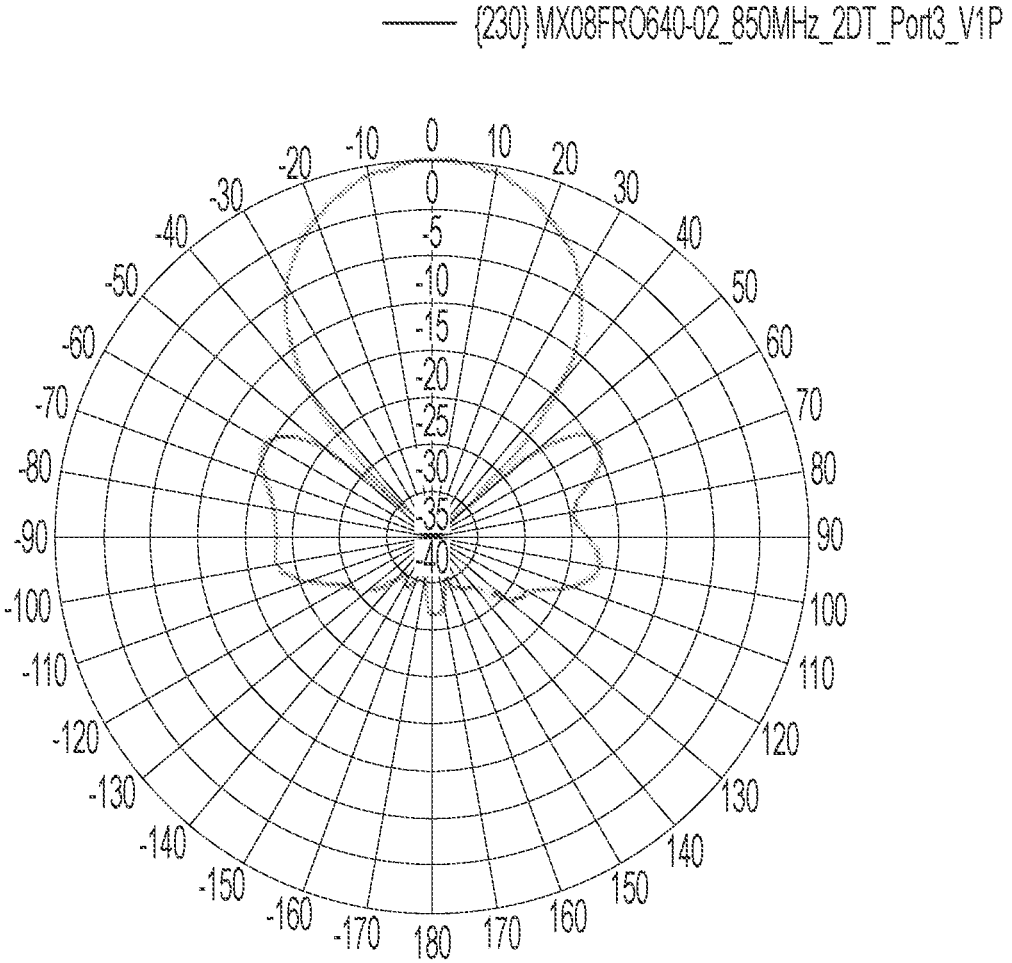
Figure 10C:
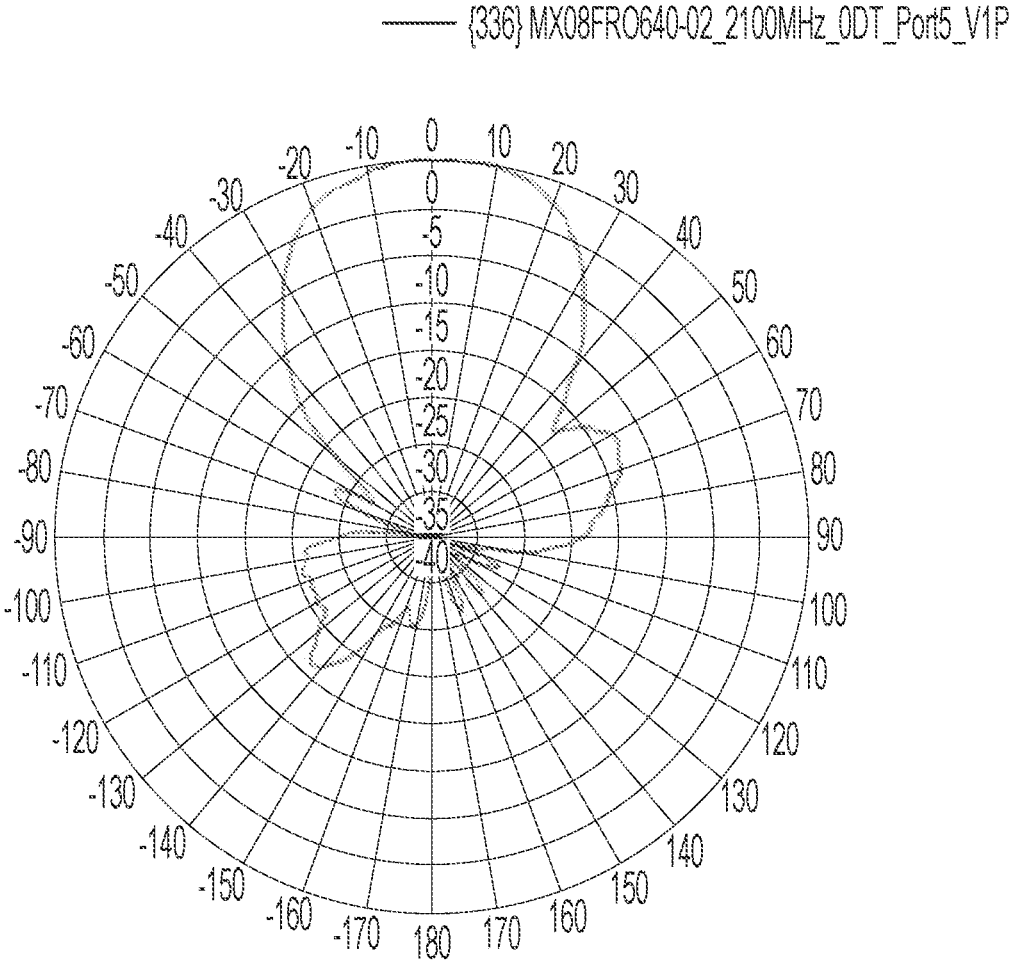
FIG. 10*c* illustrates an azimuthal gain pattern for an example HB frequency for an exemplary 6 foot antenna according to the disclosure.
Figure 11A:
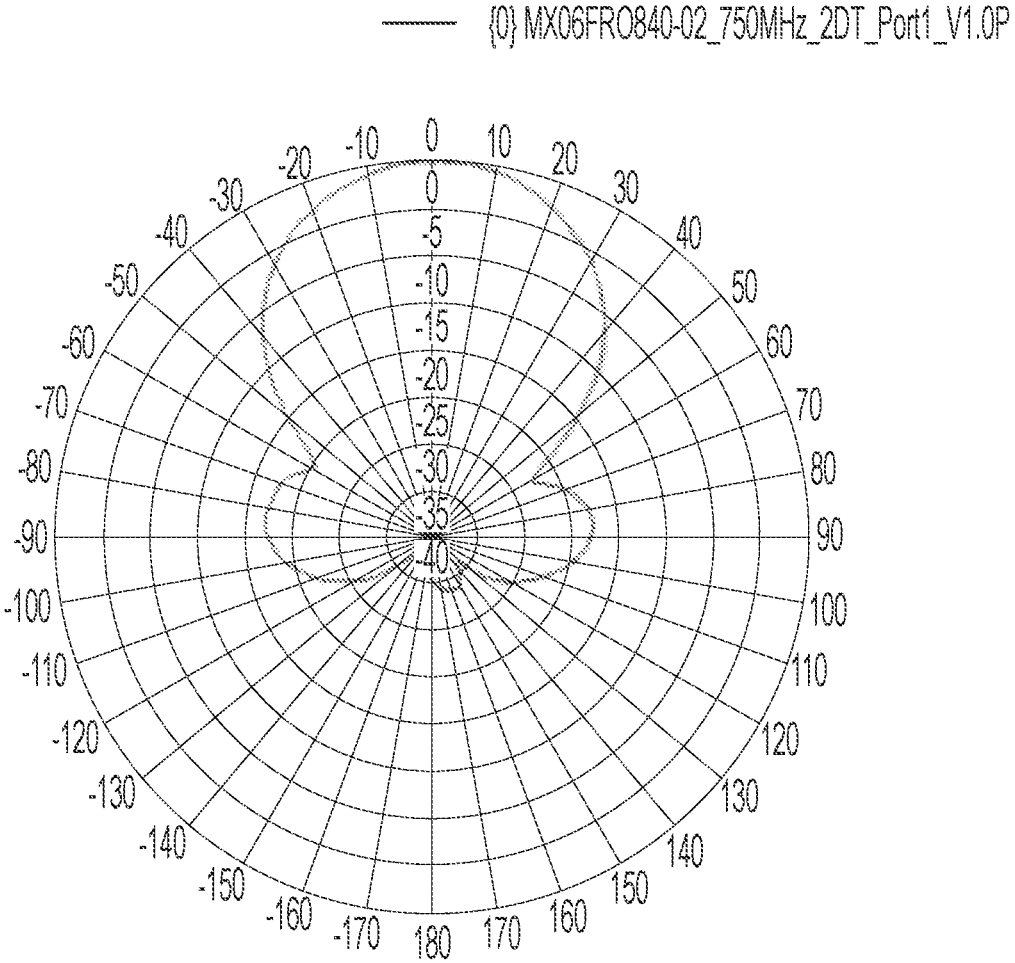
FIGS. 11*a* and 11*b* illustrate azimuthal gain patterns for two different LB frequencies for an exemplary 8 foot antenna according to the disclosure.
Figure 11B:
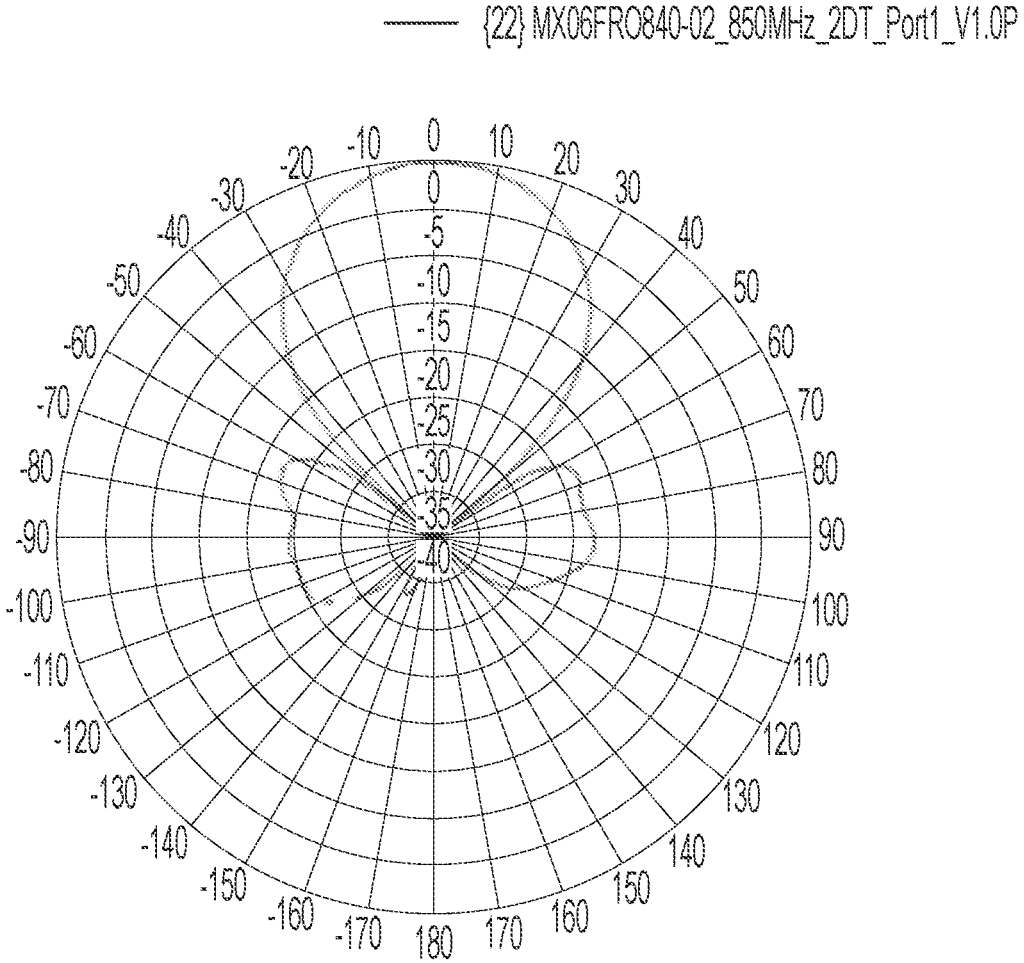
Figure 11C:
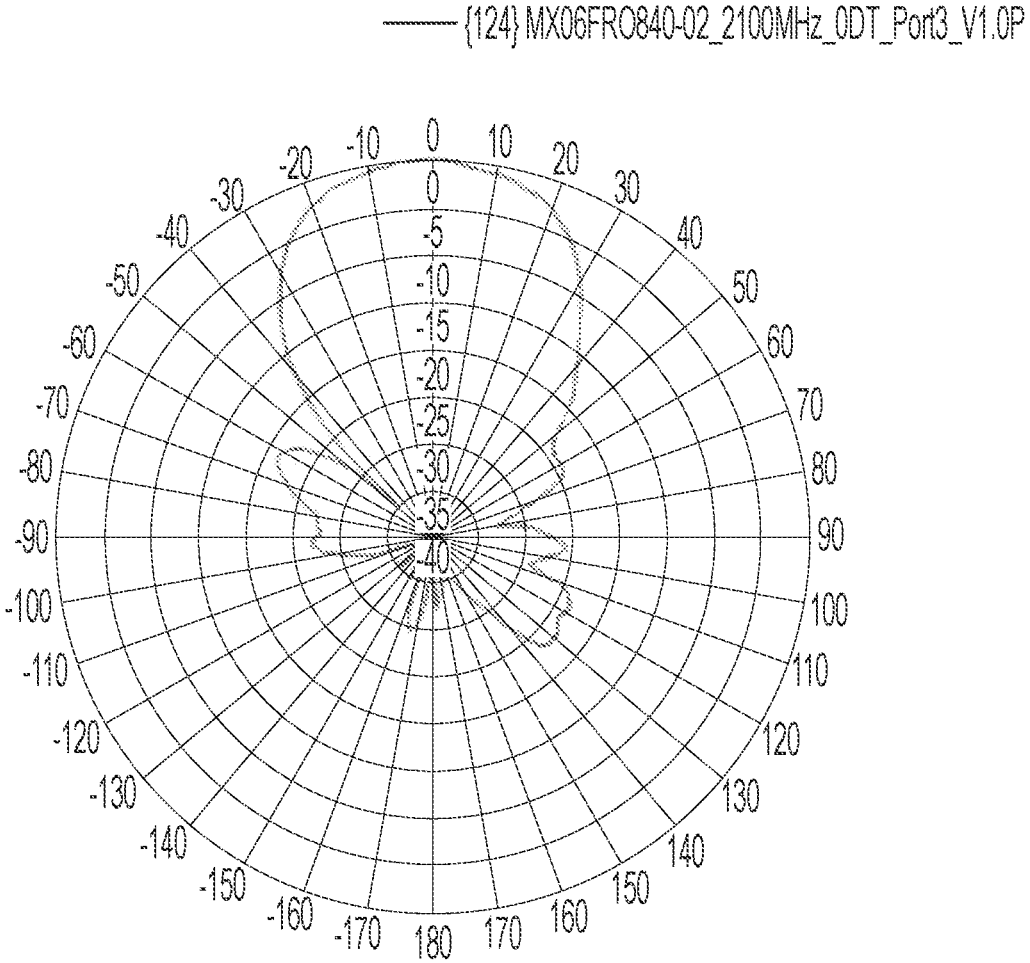
FIG. 11*c* illustrates an azimuthal gain pattern for an example HB frequency for an exemplary 8 foot antenna according to the disclosure.

FIGS. 10*a* and 10*b* illustrate example azimuthal gain patterns for two different LB frequencies for an exemplary 6 foot antenna according to the disclosure. FIG. 10*c* illustrates an example azimuthal gain pattern for a given HB frequency for an exemplary 6 foot antenna according to the disclosure. FIGS. 11*a* and 11*b* illustrate example azimuthal gain patterns for two different LB frequencies for an exemplary 8 foot antenna according to the disclosure. FIG. 11*c* illustrates an example azimuthal gain pattern for a given HB frequency for an exemplary 8 foot antenna according to the disclosure.

It will be understood that variations to array faces 700 and 800 as described above are possible and within the scope of the disclosure. For example, variations to the patterns of first and second unit cells 105/110, and the specific attenuation of the power distribution configurations may vary with differing resulting gain patterns.

While various embodiments of the present invention have been described above, it should be understood that they have been presented by way of example only, and not limitation. It will be apparent to persons skilled in the relevant art that various changes in form and detail can be made therein without departing from the spirit and scope of the present invention. Thus, the breadth and scope of the present invention should not be limited by any of the above-described exemplary embodiments but should be defined only in accordance with the following claims and their equivalents.

What is claimed is:

1. A multiband antenna, comprising:

a plurality of first unit cells, each first unit cell having two first high band radiator clusters disposed side by side along an azimuth axis, and two first low band radiators, each of the first low band radiators disposed substantially at a phase center of a corresponding first high band radiator cluster; and a plurality of second unit cells, each second unit cell having two second high band radiator clusters disposed side by side along the azimuth axis, and a second low band radiator disposed between the two adjacent second high band radiator clusters, wherein the pluralities of first and second unit cells are arranged along an elevation axis.

2. The multiband antenna of claim 1, wherein the first low band radiators and the second low band radiator are substantially similar, and wherein the first high band radiator clusters and the second high band radiator clusters are substantially similar.

3. The multiband antenna of claim 1, wherein each of the first and second high band radiator clusters comprises four high band radiators.

4. The multiband antenna of claim 1, wherein for each first unit cell each corresponding first low band radiator is disposed substantially at the phase center with an offset, wherein the offset has a direction along the azimuth axis and away from a center of the antenna.

5. The multiband antenna of claim 1, wherein the multiband antenna comprises four first unit cells and three second unit cells, wherein the first and second unit cells are disposed in an alternating fashion.

6. The multiband antenna of claim 1, wherein the plurality of first unit cells and the plurality of second unit cells are arranged so that there is a predominance of unshadowed high band radiators in a center region of the multiband antenna, and so that there is a predominance of low band radiators in an outer region of the multiband antenna along the elevation axis.

7. The multiband antenna of claim 1, further comprising:

a maximum power zone;

two first attenuation power zones disposed adjacent to the maximum power zone along the elevation axis; and two second attenuation power zones, each disposed adjacent to a corresponding first attenuation power zone along the elevation axis.

8. The multiband antenna of claim 7, wherein the two first attenuation zones have an attenuation of −2 dB, and wherein the two second attenuation zones have an attenuation of −5 dB.

9. The multiband antenna of claim 7, wherein:

the maximum power zone comprises a second unit cell;

each of the first attenuation power zones comprises a first unit cell; and each of the second attenuation power zones comprises a first unit cell and a second unit cell, wherein the second unit cell of each of the second attenuation power zones is adjacent to a corresponding first attenuation power zone.

10. The multiband antenna of claim 1, further comprising:

at least one third unit cell having a low band radiator and not having any high band radiators; and at least one fourth unit cell having two low band radiators and not having any high band radiators, wherein the at least one third unit cell and the at least one fourth unit cell are disposed along the elevation axis.

11. The multiband antenna of claim 10, wherein the at least one third unit cell and the at least one fourth unit cell are disposed in a cluster along the elevation axis.

12. The multiband antenna of claim 10, further comprising:

a low band maximum power zone;

a high band maximum power zone;

a lower low band first attenuation power zone disposed adjacent to the low band maximum power zone in a first direction along the elevation axis;

a lower high band first attenuation power zone disposed adjacent to the high band maximum power zone in a first direction along the elevation axis;

an upper low band first attenuation power zone disposed adjacent to the low band maximum power zone in a second direction along the elevation axis;

an upper high band first attenuation power zone disposed adjacent to the high band maximum power zone in a second direction along the elevation axis a lower low band second attenuation power zones disposed adjacent to the lower low band first attenuation power zone along the elevation axis;

a lower high band second attenuation power zones disposed adjacent to the lower high band first attenuation power zone along the elevation axis;

an upper low band second attenuation power zone disposed adjacent to the upper low band first attenuation power zone along the elevation axis; and an upper high band second attenuation power zone disposed adjacent to the upper high band first attenuation power zone alog the elevation axis.

13. The multiband antenna of claim 12, wherein the lower low band first attenuation zone, the upper low band first attenuation zone, the lower high band first attenuation zone, and the upper high band first attenuation zone have an attenuation of −2 dB, and wherein lower low band second attenuation zone, the upper low band second attenuation zone, the lower high band second attenuation zone, and the upper high band second attenuation zone have an attenuation of −5 dB.

14. The multiband antenna of claim 12, wherein:

the low band maximum power zone comprises two first unit cells;

the lower low band first attenuation power zone comprises two second unit cells;

the upper low band first attenuation power zone comprises a second unit cell that is adjacent to low band maximum power zone, and a third unit cell;

the lower low band second attenuation zone comprises two first unit cells; and the upper low band second attenuation zone comprises two fourth unit cells.

15. The multiband antenna of claim 14, wherein:

the high band maximum power zone comprises a second unit cell;

the lower high band first attenuation zone comprises a second unit cell;

the upper high band first attenuation power zone comprises a first unit cell;

the lower high band second attenuation zone comprises two first unit cells;

the upper high band second attenuation zone comprises a second unit cell and a third unit cell.

16. The multiband antenna of claim 1, further comprising a reflector plate, wherein each of the low band radiators has a low band radiator radiator that is disposed at a first height above the reflector plate that is approximately one half of a wavelength corresponding to a center frequency of a low band, and wherein each of the high band radiators has a high band radiator assembly that is disposed at a second height above the reflector plate that is approximately one quarter of the wavelength corresponding to the center frequency of the low band.

17. The multiband antenna of claim 16, wherein the high band radiator assembly comprises:

a high band radiator plate; and a triple stack passive radiator that is disposed above the high band radiator plate, wherein the second height corresponds to a height of a top radiator plate within the triple stack passive radiator.

18. A multiband antenna, comprising:

a plurality of first unit cells, each first unit cell having at least two first high band radiator clusters disposed side by side along an azimuth axis, and a first quantity of low band radiators disposed substantially at a phase center of a corresponding first high band radiator cluster, wherein the first unit cells are designed to have a superior low band performance relative to high band performance; and a plurality of second unit cells, each second unit cell having at least two second high band radiator clusters disposed side by side along the azimuth axis, and a second quantity of low band radiators, each of the second quantity of low band radiators disposed between two adjacent first high band radiator clusters, wherein the second unit cells are designed to have a superior high band performance relative to low band performance, wherein the first quantity is not equal to the second quantity, and wherein the pluralities of first and second unit cells are interspersed and arranged heterogeneously along an elevation axis.

19. The multiband antenna of claim 18, wherein the first quantity is equal to two and the second quantity is equal to one.

* * * * *